United States Patent [19]

Farng et al.

[11] Patent Number: 5,037,567

[45] Date of Patent: Aug. 6, 1991

[54] PHOSPHORUS-SULFUR OLEFINIC DERIVATIVES AS MULTIFUNCTIONAL LUBRICANTS AND MULTIFUNCTIONAL ADDITIVES FOR LUBRICANTS

[75] Inventors: Liehpao O. Farng, Lawrenceville; Andrew G. Horodysky, Cherry Hill, both of N.J.; Derek A. Law, Yardley, Pa.

[73] Assignee: Mobil Oil Corporation, Fairfax, Va.

[21] Appl. No.: 292,079

[22] Filed: Dec. 30, 1988

[51] Int. Cl.[5] ..... C10M 137/04

[52] U.S. Cl. ..... 252/32.7 E; 252/46.6; 252/46.7; 558/109

[58] Field of Search ..... 252/32.7 E, 46.6, 46.7; 558/109

[56] References Cited

U.S. PATENT DOCUMENTS

| | | | |
|---|---|---|---|
| 2,528,732 | 11/1950 | Augustine | 558/109 |
| 3,074,990 | 1/1963 | Cyba | 252/32.7 E |
| 3,089,850 | 5/1963 | McConnell et al. | 252/32.7 E |
| 3,340,332 | 9/1967 | Oswald et al. | 558/109 |
| 3,483,278 | 12/1969 | Mueller et al. | 558/109 |
| 3,574,795 | 4/1971 | Oswald et al. | 558/109 |
| 4,152,275 | 5/1979 | Horodysky et al. | 252/46.6 |
| 4,153,562 | 5/1979 | Jaruzelski | 252/46.6 |
| 4,212,753 | 7/1980 | Horodysky | 252/46.6 |
| 4,668,409 | 5/1987 | Yamaguchi et al. | 252/32.7 E |

*Primary Examiner*—Jacqueline V. Howard
*Attorney, Agent, or Firm*—Alexander J. McKillop; Charles J. Speciale; Howard M. Flournoy

[57] ABSTRACT

Addition reaction products of phosphorus and sulfur-containing moieties to alpha olefins, internal olefins and functionalized olefins provides superior multifunctional additives for lubricating oils, greases and fuels and/or superior functionalized lubricants with multifunctional properties.

68 Claims, No Drawings

PHOSPHORUS-SULFUR OLEFINIC DERIVATIVES AS MULTIFUNCTIONAL LUBRICANTS AND MULTIFUNCTIONAL ADDITIVES FOR LUBRICANTS

BACKGROUND OF THE INVENTION

This invention is directed to phosphorus and sulfur derived oelfinic adducts as multifunctional lubricant additives or multifunctional fluids or partial replacement fluids.

The use of metallic phosphorodithioate derivatives, such as zinc dithiophosphate, has been well-known for their multifunctional antioxidant/antiwear/anticorrosion properties in a variety of lubricant applications, especially in engine oils.

The use of ashless phosphorodithioate derivatives, such as alkylmercapto-alkyl,-O,O-dialkyldithiophosphates (U.S. Pat. No. 2,759,010), phosphorodithioate easter (U.S. Pat. No. 3,544,465, 3,350,348 and 3,644,206), reaction products of sulfurized olefin adducts of phosphorodithioic acids (U.S. Pat. No. 4,212,753), and addition products of dihydrocarbyl thiophosphoric acids to conjugated dienes (U.S. Pat. No. 3,574,795), have found widespread lubricant application as multifunctional anticorrosion, antiwear, and antioxidant additives, as well as agriculture applications as herbicides and pesticides.

Lubricants, such as lubricating oils and greases, are subject to oxidative deterioration at elevated temperatures or upon prolonged exposure to the elements, heat, light, oxidants, or catalysts. Such deterioration is evidenced, in many instances, by an increase in acidity and in viscosity, and when the deterioration is severe enough, it can cause metal parts to corrode. Additionally, severe oxidation leads to a loss of lubrication properties, and in especially severe cases this may cause complete breakdown of the device being lubricated. Many additives have been tried, however, many of them are only marginally effective except at high concentrations. Improved antioxidants are clearly needed.

Antioxidants or oxidation inhibitors are used to minimize the effects of oil deterioration that occur when, for example, hot oil is contacted with air. The degree and rate of oxidation will depend on temperature, air and oil flow rates and, of particular importance, on the presence of metals that may catalytically promote oxidation. Anitoxidants generally function by prevention of chain peroxide reaction and/or metal catalyst deactivation. They prevent the formation of acid sludges, darkening of the oil and increases in viscosity due to the formation of polymeric materials.

Water (moisture) is another critical problem. In spite of even extraordinary precautionary efforst water is found as a film or in minute droplets in vessels containing various hydrocarbon distillates. This brings about ideal conditions for corrosion and damage of metal surfaces of the vessels and the materials contained therein. Also in the lubrication of internal combustion engines, for example, quantities of water are often present as a separate phase within the lubricating system. Another serious problem in respect to metallic surfaces in contact with adjacent metallic surfaces is the surface wear caused by the contact of such surfaces. One material capable of effectively coping with such problems as these simultaneously, is highly desireous.

It has now been found that the use of addition adducts of dithiophosphoric acid to internal olefins, functionalized olefins and alpha-olefins provides good high and low temperature lubricating properties with exceptional antioxidant and antiwear/EP activity with potential corrosion inhibiting, friction reducing, and high temperature stabilizing properties. These phenomena are equally advantageous when these compositions are used at less than 100% or a 0–10% additive concentrations, or 10–90% partial fluid replacement levels.

Accordingly, it is an objective of this invention to provide lubricant compositions of improved multifunctional capability having anitoxidant/high temperature stabilizing properties, antiwear/EP activity with corrison inhibiting and friction reducing characeristics. It is a further objective to provide novel additive products derived from the aforementioned addition adducts of dithiophosphoric acid to various olefinic materials and to provide novel lubricant compositions containing the hereinabove/below described additive products in amounts of up to about 100%.

SUMMARY FO THE INVENTION

This application is directed to lubricant compositions containing small concentrations of the reaction products of phosphorus and sulfur containing moietires with alpha olefins, internal olefins and functionalized olefins which are suitable for use in both mineral and synthetic lubricating oils, greases and fuels, and to superior functionalized lubricants with multifunctional antiwear and antioxidant properties and to lubricant compositions wherein the above mentioned reaction products comprise a major amount of the composition, i.e., up to 100% thereof.

Accordingly, it is believed that the compositions of matter disclosed in this application are both novel and not anticipated by prior art. It is also believed that use of these polyfunctional compositions as lubricating fluids and as additives in lubricants (mineral and/or synthetic) is also unique and provide unanticipated performance benefits due to multiple internal synergism. It is also believed that the process or methods for improvement of such above lubricant properties via addition of same to lubricants is also unique.

Since these are built-in type multifunctionalized lubricants wherein functional dithiphosphoric group have been chemically bound into the lubricant network, they offer decided advantages over the usual formulated lubricants, particularly where volatility or extraction with solvent is considered to be important.

This unique multidimensional internal synergism concept is believed to be applicable to similar structures containing (a) olefin moieties including internal olefins and alpha-olefins, as well as functionalized olefins, (b) phosphorodithioate moieties, or any other phosphorus and sulfur containing groups, and (c) sulfur/oxygenate/nitrogenate-containing substituents to these uncommon phosphorodithioate groups within the same molecules.

DESCRIPTION OF PREFERRED EMBODIMENTS

It has been found that lubricants and/or lubricant additives made from internal olefins, alpha-olefins and functionalized olefins with sulfur/phosphorus-containing moieties, such as dithiophosphoric acids, preferably untraditional multifunctional dithiophosphoric acids, possess excellent lubricating properties coupled with very good antioxidant, antiwear/EP, and friction reducing activities. Although applicants do not wish to be bound by any theory both the phosphorodithioate moiety (especially these sulfur, nitrogen, oxygen containing untraditional phosphorodithioates) and the olefin moiety are believed to provide the basis for the unique internal synergistic anitoxidant activity, thermal stability, and lubricity.

The phosphorodithioate group is believed to contribute additional antiwear properties to these functionalized additives/lubricants, and the additional sulfur/oxygenate/nitrogenate substituent groups bound within the dithiophosphoric acids are believed to contribute additional friction reducing, rust inhibiting, anitoxidant, and antiwear properties. All of these beneficial properties are believed to be enhanced as a rsult of this novel multidimensional internal synergism. For example, the process of reducing both friction and wear of a wide temperature range, high stability lubricant via addition of 0–100% of an adduct of a diol-derived phosphorodithioate and olefin-containing organic compounds, such as pentaerythritol tetraoleate esters, is unique and not comprehended by any prior art. Internal olefins and alpha-olefins are preferred, but others an likewise be used advantageously in this disclosure.

We also believe that lubricant formulations containing the above compositions of matter and additional supplementary additives or fluids chosen from the following group are novel: mineral oils, non-functionalized synthetic fluids, dispersants, detergents, viscosity index improvers, alternate EP/antiwear additives, antioxidants, pour depressants, emulsifiers, demulsifiers, corrosion inhibitors, antirust additives, antistaining additives, friction reducers, and the like. Post reaction of these unique phosphorus-sulfur/internal olefins, alpha-olefins, or functionalized olefins with small amounts of volatile, functionalized olefins such as vinyl esters (vinyl acetate), vinyl ethers (butyl vinyl ether), acrylates, methacrylates, or metal oxides (such as zinc oxide), hydroxides, carbamates, etc. to further improve desirable properties of those compositions can be optionally used where indicated. For example, post-reaction with small molar amounts of zinc oxide can be advantageously used to improve the EP/antiwear, thermal and oxidative stability and corrosion properties to a fifth-phase of multidimensional interal synergism. Such post-reactions can also improve the process of making the above phosphorus and sulfur-containing addities or lubricants by negating the need for absolute conversion of the phosphorus-sulfur intermedaite during reaction with the olefin.

Furthermore, the coupling of two distainct groups of uncommon functionalized phosphorodithioates and unique untraditional olefins derived from functionalized olefins enhanced their intrinsic properties through internal synergism. The untraditional olefins possess improved lubricity, improved viscoelasticity, better stabilizy, and lower cost than traditional synthetic lubricants. These uncommon sulfur/oxygen/nitrogen- containing alcohol-derived phosphorodithioates possess various kinds of good functional characteristics which could improve the overall performance of the coupled adducts.

For example, functionalized olefin adducts of aliphatic vicinal diol-derived phosphorodithioates (I) not only possess the expected antioxidant and antiwear properties, but also the possible friction reduction property of vicinal diol groups. Likewise, olefin adducts of sulfide-containing vicinal diol-derived phophorodithioates (II) would provide better antioxidant and antiwear properties with respect to the additional sulfur content providing a fourth tier of internal synerism in the molecule. Similarly, olefin adducts of ether alcohol-derived phosphorodithioates (III) would provide improved chelating ability and solubility/detergency with the ether linkage. Catechol-derived (IV) or resorcinol-derived phosphorodithioates contain an intrinsic antioxidant moiety which can be released under hydrolytic conditions to improve the oxidative stability of the olefin adducts. Hydroxyester derived phosphorodithioate-olefin adducts (V) may improve frictional properties through the alcohol-ester moiety and some heterocyclic substituted alcohol derived phosphorodithioic acid-olefin adducts, such as imidazoline substituted alcohol derived compounds (VI) may contribute substantial corrosion inhibiting property to the multidimensional internally synergistic composition. These novel compositions of matter (generalized structure set forth hereinbelow as indicated) have not been previously used or disclosed for use as additives in lubricant or fuel applicants.

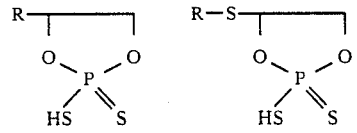
(I)

(II)

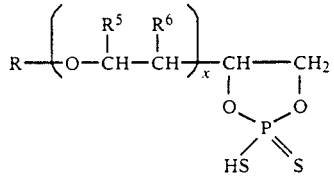
(III)

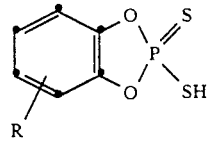
(IV)

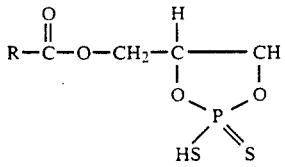
(V)

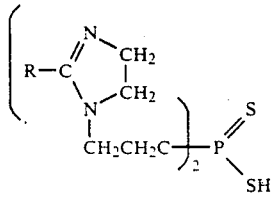

Also includes are open chain oligomeric derivatives and open chain structures related to structures I to VI shown above, where the phosphorus moiety is not contained within a 5 or 6 membered phosphorus ring. Direct phosphosulfurization with a phosphorus and sulfur source such as phosphorus pentasulfide is expected to provide many of above recited, but not all of the multifunctional properties due to internal synergism. These compositions of matter and use disclosures are also believed to be novel. Post reactions of these unique compositions as described hereinabove are also believed to novel.

The following are some of the materials from which the phosphorus-sulfur moieties may be derived. It is by no means an exhaustive list, any other suitable material known in the art may also be used herein: O,O-Dialkyl phosphorodithioic acids (made by the reaction of alcohols with phosphorus pentasulfide), O,O-diaryl phosphordithioic acids (made by the reaction of phenols with phosphorus pentasulfide), or other phosphorodithionic acids, such as diol-derived phosphoroodithioic acids, ether alcohol-derived phosphorodithioic acids, alkyl catechol-derived or resorcinol-derived phosphorodithioic acids, alkyl-aryl and aryl-alkyl derived phosphorodithioic acids, hydroxyester-derived phosphorodithioic acids, (e.g., glycerol mono- or di- oleates, pentaerythritol di-oleate, trimethylol propane diesters, succinate-alkoxylated esters, etc.), heterocyclic-substituted alcohol-derived phosphorodithioic acids (e.g., oxazoline, imidazoline-substituted alcohol derived compounds like 2-(8-heptadecencyl)-4,5-dihydro-1H-imidazole-1-ethanol derived phosphorodithioic acids), polyol-derived phosphorodithioic acids, polyethoxylated amine-derived phosphorodithioic acids, polyethoxylated amine-derived phosphorodithioic acids, can be reacted with alpha-olefins, internal olefins or functionalized olefins to form the addition lubricant adducts as shown in the generalized reaction below.

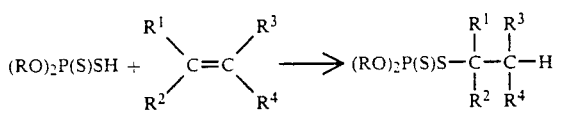

Where R is from about $C_3$ to about $C_{50}$ hydrocarbyl or from about $C_3$ to about $C_5$ hydrocarbyl/oxyhydrocarbylene, or other oxygen containing hydrocarbyl, or sulfur, nitrogen-containing hydrocarbyl, or hetercyclic containing-hydrocarbyl, or mixtures thereof.

Where $R^1$, $R^2$, $R^3$, $R^4$ are hydrogen (with the proviso that all can not be hydrogen at the same time) or $C_1$ to about $C_{500}$ hydrocarbyl (more preferably about $C_8$ to about $C_{100}$ hydrocarbyl), or sulfur/oxygen/nitrogen containing hydrocarbyl, or heterocyclic containing hydrocarbyl (preferably functionalized olefins, olefin-containing esters, etc), or mixtures thereof.

Where $R^5$ and $R^6$ are hydrogen or $C_1$ to about $C_{30}$ hydrocarbyl.

Although much of the beneficial properties can be derived from the use of traditional dihydrocarbyl phosphorodithioic adducts of unique specialized lube olefins, an added dimension of internally synergistic multifunctional behavior can be achieved with the use of novel and unique functionalized phosphorus-sulfur intermediates. Lubricants range olefins include specifically oligomers of decene-1 and/or octene-1 such as the trimer, tetramer and/or pentamer of decene and/or octene.

Suitable olefins include but are not limited to $C_2$ to about $C_{100}$ alpha- and internal olefins, oligomers or polymers thereof, any of which may be substituted with oxygen, nitrogen or sulfur. Suitable alpha-olefins include, for example, propylene, 1-butene, 1-hexene 4-methyl-1-pentene, 1-octene or mixtures thereof. Any suitable internal olefin may be used such as 2-hexene. By functionalized olefin is meant any olefin having other than methylene groups, for example, an unsaturated alcohol, ether, ester or sulfide or nitrogen groups.

Generally speaking, preparation of the various reactants, their reaction times, temepratures, pressures and quantities, utilized in the reactions may vary widely and are not believed to be critical (any conditions known in the art to be suitable may be used). Usually equimolar amounts or slightly more than or slightly less than a 1:1 ratio of reactants may be used. The temperature may vary from ambient to 250° C. or more and the pressure may be ambient, or autogenous or slightly higher than atmospheric with reactions times to 72 hours or more.

The additives may be incorporated into any suitable liquid fuel or lubricating media which comprises oils of lubricating viscosity, e.g., mineral or synthetic; or mixtures of mineral and synthetic or greases in which the aforemtnioned oils are employed as a vehicle or into such functional fluids as hydraulic fluids, brake fluids, power transmission fluids and the like. In general, mineral oils and/or synthetic, employed as the lubricant oil, or grease vehicle may be of any suitable lubricating viscosity range, as for example, from about 45 SSU at 100° F. to about 6000 SSU at 100° F., and, preferably, from about 50 to about 250 SSU at 210° F. These oils may have viscosity indices from below zero to about 100 or higher. Viscosity indices from about 70 to about 95 are preferred. The average molecular weight of these oils may range from about 250 to about 800. Where the lubricant is to be employed in the form of a grease, the lubricating oil is generally employed in an amount sufficient to balance the total grease composition, after accounting for the desired quantity of the thickening agent and other additive components to be included in the grease formulation.

In instances where synthetic oil, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylolpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorous-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis (p-phenoxy phenyl) ether, phenoxy phenylethers, etc.

Fully formualted lubricating oils may include a variety of additives (for their known purpose) such as dispersants, detergents, inhibitors, antiwear agents, antioxidant, antifoam, pour depressant and other additives including phenates, sulfonates and zinc dithiophosphates. As hereinbefore indicated, the aforementioned additive compounds may be incorporated as multifunctional agents in grease compositions. When high temperature stability is not a requirement of the finished grease, mineral oils having a viscosity of at least 40 SSU at 150° F., and particularly those falling within the range from about 60 SSU to about 6,000 SSU at 100° F. may be employed. The lubricating vehicles of the improved greases of the present invention, containing the above described additives, are combined with a grease forming quantity of a thickening agent. For this purpose, a wide variety of materials dispersed in the lubricating vehicle in grease-forming quantities in such degree as to impart to the resulting grease composition the desired consistency. Exemplary of the thickening agents that may be employed in the grease formulation are non-soap thickeners, such as surface-modified clays and silicas, aryl ureas, calcium complexes and similar materials. In general, grease thickners may be employed which do not melt and dissolve when used at the required temperature within a particular environment; soap thickeners such as metallic (lithium or calcium) soaps including hydroxy stearate and/or stearate soaps can be used however, in all other respects, any material which is noramlly employed for thickening or gelling hydrocarbon fluids or forming greases can be used in preparing the aforementioned improved greases in accordance with the present invention.

Included among the preferred thickening agents are those containing at least a portion of alkali metal, alkaline earth metal or amine soaps of hydroxyl-containing fatty acids, fatty glycerides and fatty esters having from 12 to about 30 carbon atoms per molecule. The metals are typified by sodium, lithium, calcium and barium. Preferred is lithium. Preferred members among these acids and fatty materials are 12-hydroxystearic acid and glycerides containing 12-hydroxystearates, 14-hydroxystearic acid, 16-hydroxystearic acid and 6-hydroxystearic acid.

The entire amount of thickener need not be derived from the aforementioned preferred members. Significant benefit can be attained using as little thereof as about 15% by weight of the total thickener. A complementary amount, i.e., up to about 85% by weight of a wide variety of thickening agents can be used in the grease of this invention. Included among the other useful thickening agents are alkali and alkaline earth metal soaps of methyl-12-hydroxystearate, diesters of a $C_4$ to $C_{12}$ dicarboxylic acid and tall oil fatty acids. Other alkali or alkaline earth metal fatty acids containing from 12 to 30 carbon atoms and no free hydroxyl may be used. These include soaps of stearic and oleic acids.

Other thickening agents include salt and salt-soap complexes as calcium stearate-acetate (U.S. Pat. No. 2,197,263), barium stearate acetate (U.S. Pat. No. 2,564,561), calcium, stearate-caprylate-acetate complexes (U.S. Pat. No. 2,999,065), calcium caprylate-acetate (U.S. Pat. No. 2,999,066), and calcium salts and and soaps of low-, intermediate-and hihg-molecular weight acids and of nut oil acids.

As has been discussed hereinabove, the reaction products are useful as multifunctional antiwear/antioxidant/antirust agents. They are added to the lubricating medium in amounts sufficient to impart such properties to the lubricant. More particularly, such properties will be imparted to the lubricant by adding from about 0.001% to about 10% by weight, preferably from about 0.01% to abot 3%, of the neat product.

As mentioned hereinabove, these lubricating additives compositions themselves maybe used in amounts up to 100% to provide the lubricating media in its entirety. Thus as mentioned, the adducts described herein maybe be used in amounts of up to 100% to provide the complete lubricating media or they may use in amounts less than 100% and with fuels to the extent of from about 5 lbs to about 250 lbs per 1000 bbls. of fuel.

The liquid fuels comtemplated include the liquid hydrocarbons, such as gasoline, fuel oil and diesel oil and the liquid alcohols such as methyl alcohol and ethyl alcohol. The fuels also include mixtures of alcohols as well as mixtures of alcohols and liquid hydrocarbons. Having described the invention in general terms the following examples are exemplary and are not intended to be limitations on the scope of this invention.

EXAMPLE 1

Approximately 71.0 gm dodecyl catechol (a mixture of dodecyl catechol [75%] and didodecyl catechol [25%] made from the reaction of catechol and dodecene), 22.2 gm (0.1 mole) phosphorus pentasulfide, and 100 ml toluene were charged into a stirred reactor equipped with a condenser, thermometer, nitrogen purge inlet and outlet to caustic scrubber. The reaction mixture was heated to reflux toluene temperature and maintained for two hours. Thereafter, the product was cooled and filtered to remove unreacted solids. The toluene and other volatiles were removed at 120° C. by vacuum distillation. The final product is a reddish oil weighting 83.1 gm.

EXAMPLE 2

Approximately 18.0 gm of the above product of Example 1, and 5.6 gm of decene-1 (0.04 mole) were mixed together in a 250 ml reaction flask under $N_2$ purge. This mixture was heated at 75° C. for 24 hours, then at 115° 120° C. for one hour. Upon cooling down to about 75° C., the mixture was treated with 0.2 ml vinyl acetate and heated for one hour. Thereafter, the excess vinyl acetate was removed under vacuum distillation at 90° C. The residue is the desired product weighing 23.6 gm.

EXAMPLE 3

Equal molar amounts of Indopol 14 (commercial polybutene, 6.4 gm) and the above product of Example 1 (9.0 gm), were mixed under nitrogen for 72 hours and reacted at 115° 120° C. for one hour. The mixture was cooled to about 75° C. and 0.5 ml vinyl acetate was added to continue the reaction for one hour. Then the reaction temperature was raised to about 100° C. and heated under vacuum to distill off excess vinyl acetate. The product was a light brown oil weighing 16 gm.

EXAMPLE 4

Equal molar amount of dodecene-1 (14.0 gm. 0.1 mole) and 1,2-dodecane diol-derived phosphorodithioic acid (29.6 gm, 0.1 mole) were reacted at 75° C. for three hours, and at 115°-120° C. for three additional hours. Thereafter, the reaction followed the same workup procedure as Example 1 to obtian 44.6 gm of light yellow, oily product.

EXAMPLE 5

At 1:4 molar ratio of pentaerythritol tetraoleate (23.7 gm, 0.02 mole) and 1,2-dodecane diol-derived phosphorodithioic acid (21.4 gm, 0.08 mole) were reacted at 75° C. for 20 hours under nitrogen purge. The 1 ml vinyl acetate was added and heated for 30 minutes. Thereafter, the reaction mixture was heated at 85°-90° C. under vacuum to remove excess vinyl acetate. The product was a light yellow oil weighting 45.6 gm.

EXAMPLE 6

Pentaerythritol tetraoleate and the above product of Example 1 were mixed together at 1:4 molar ratio, and the reaction was carried out at the similar manner as described in Example 5.

EXAMPLE 7

A slight excess of Indopol 14 (polybutene, 32.o gm, 0.1 mole) and 1,2-dodecane diol-derived phosphorodithioic acid (26.8 gm) were reacted according to the similar procedure as described in Example 4 to obtian 59.5 gm of product.

The products of selected examples were evaluated for antiwear activity using Four-Ball Wear Test (ASTM-Method D2266, Table 1) as lubricant additives at 1% additives at concentration in minerals.

The tests were conducted at 2000 rpm, 200° F.

TABLE 1

Four-Ball Wear Test (2000 rpm, 200° F., 60 Kg load, 30 mins)

| Item | Wear-Scar Diameter (mm) |
|---|---|
| Mineral based oil (80% solvent paraffinic bright, 20% solvent paraffinic neutral mineral oils) | 4.03 |
| 1% of Example 4 in above mineral-based oil | 0.68 |
| 1% of Example 5 in above mineral-based oil | 2.19 |
| 1% of Example 7 in above mineral-based oil | 0.71 |
| 1% of Example 6 in above mineral-based oil | 0.75 |
| 1% of Example 3 in above mineral-based oil | 2.16 |
| 1% of Example 2 in above mineral-based oil | 1.89 |

The data clearly demonstrate the antiwear properties exhibited by the compositions described in the present patent application.

The use of these novel lubricants and lubricant additives and fuel compositions with built-in, desirable properties provies premium quality automotive and industrial lubricants, fuels or additives of significantly enhanced oxidative stability, extended service life, reduced wear and increased load carrying capability. Furthermore, the coupling of the uniquely low cost, and good compatiblity, lubricity, viscoelasticity of funcationalized olefins with all the good potential characteristics of these non-traditional phosphorodithioic acid moieties will greatly benefit the overall performance of these types of lubricants. The functionalized lubricants described in this application do not contain any potentially undesirable migrating additives (volatile or semi-volatile) and instead may simplify complicated formulation procedures. These unique multifunctional compositions may also ultimately find widespread commercial use as additives in synethetic or mineral oil-based lubricants or in semi-synthetic lubricants. These phosphorodithioic acid-added olefin adducts can be commercially made by using economically favorable processes which can be readily implemented using known technology in existing equipment.

Althouth the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

We claim:

1. A lubricant composition comprising a major amount of an oil of lubricating viscosity or grease or other solid lubricant prepared therefrom and a minor multi-functional antioxidant/antirust/antiwear/corrosion inhibiting amount of an addition reaction product of phosphorus and sulfur containing moieties comprising phosphorodithioate moieties and phosphorodithioate moieties containing sulfur/oxygenate/nitrogenate-containing substituents with alpha-olefins, internal olefins and functionalized olefins or mixtures thereof selected from the group consisting of the following reaction products (1) an olefin adduct of an aliphatic vicinal diol-derived phosphorodithioate having the following general structure:

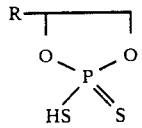

where R is about $C_3$ to about $C_{30}$ hydrocarbyl or $C_3$ to about $C_{30}$ oxygen, sulfur or nitrogen-containing hydrocarbyl or other heterocyclic containing-hydrocarbyl or mixtures thereof; (2) an olefin adduct of a sulfide containing vicinal diol-derived phosphorodithioate having the following general structure:

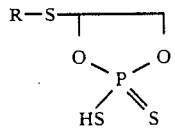

where R is the same; (3) an olefin adduct of an ether alcohol-derived phosphorodithioate having the following general structure:

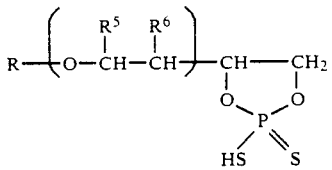

wherein R is the same and $R^5$ and $R^6$ are hydrogen or $C_1$ to about $C_{30}$ hydrocarbyl; (4) an olefin adduct of catechol-derived or resorcinol-derived phosphorodithioate having the general structure:

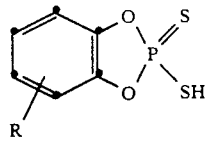

where R is the same; and (5) an olefin adduct of a hydroxyester derived phosphorodithioate-olefin adduct having the following general structure:

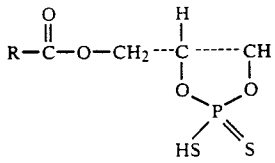

where R is the same.

2. The composition of claim 1 wherein the dithiophosphoric acid is a dialkyl or a diaryl phosphorodithioic acid.

3. The composition of claim 1 wherein said aliphatic diol-derived phosphorodithioate reaction product is an open-chain oligomeric diol-derived phosphorodithioate.

4. The composition of claim 1 wherein said reaction product is made from an internal olefin.

5. The composition of claim 1 wherein said reaction product is made from an alpha-olefin.

6. The composition of claim 1 wherein said reaction product is made from a functionalized olefin containing groups selected from unsaturated alcohols, ethers, esters or sulfide or nitrogen groups or mixtures thereof.

7. The composition of claim 5 wherein the alpha olefin is selected from the group consisting of propylene, 1-butene, 1-hexene, 4-methyl-1-pentene, 1-octene, 1-decene and 1-dodecene or oligomers or mixtures thereof.

8. The composition of claim 7 wherein the olefin is 1-butene.

9. The composition of claim 7 wherein the olefin is a polybutene oligomer.

10. The composition of claim 7 wherein said olefin is a polydecene/octene oligomer.

11. The composition of claim 7 wherein the olefin is 1-decene.

12. The composition of claim 7 wherein the olefin is 1-dodecene.

13. The composition of claim 6 wherein the functionalized olefin is an olefinic-ester.

14. The composition of claim 13 wherein wherein the olefinic ester is pentaerythritol tetraoleate.

15. The composition of claim 6 wherein the functionalized olefin is an olefinic-ether.

16. The composition of claim 1 wherein the sulfide containing diol-derived phosphorodithioate is an open chain phosphorodithioate reaction product.

17. The composition of claim 1 wherein the reaction product is made from internal olefins, alpha olefins or oligomers or mixtures thereof.

18. The composition of claim 17 wherein the alpha olefin is selected from the group consisting of of propylene, 1-butene, 1-hexene, 4-methyl-1-pentene, 1-octene, 1-decene and 1-dodecene or oligomers or mixtures thereof.

19. The composition of claim 18 wherein the olefin is 1-butene.

20. The composition of claim 18 wherein the olefin is a polybutene oligomer.

21. The composition of claim 18 wherein the olefin is a polydecene/octene oligomer.

22. The composition of claim 18 wherein the olefin is a 1-decene.

23. The composition of claim 18 wherein the olefin is a 1-dodecene.

24. The composition of claim 23 wherein said functionzlied olefin is an olefinic-ether.

25. The composition of claim 1 wherein said alcohol-derived phosphorodithioate reaction product is made from an internal olefin.

26. The composition of claim 1 wherein said alcohol-derived phosphorodithioate reaction product is made from an alpha-olefin.

27. The composition of claim 26 wherein the alpha olefin is selected from the groups consisting of propylene, 1-butene, 1-hexene, 4-methyl-1-pentene, 1-octene, 1-decene and 1-dodecene or oligomers or mixtures thereof.

28. The composition of claim 26 wherein the olefin is 1-butene.

29. The composition of claim 26 wherein the olefin is a polybutene oligomer.

30. The composition of claim 26 wherein the olefin is a polydecene/octene oligomer.

31. The composition of claim 26 wherein the olefin is 1-decene.

32. The composition of claim 25 wherein the olefin is 1-dodecene.

33. The composition of claim 1 wherein the said catechol resorcinol phosphorodithioate is an open-chain derived phosphorodithioate.

34. The composition of claim 1 wherein said reaction product is made from an alpha-olefin.

35. The composition of claim 34 wherein the alpha olefin is selected from the groups consisting of propylene, 1-butene, 1-hexene, 4-methyl-1-pentene, 1-octene, 1-decene and 1-dodecene or oligomers or mixtures thereof.

36. The composition of claim 35 wherein the olefin is 1-butene.

37. The composition of claim 35 wherein the olefin is a polybutene oligomer.

38. The composition of claim 35 wherein the olefin is a polydecene/octene oligomer.

39. The composition of claim 35 wherein the olefin is 1-decene.

40. The composition of claim 35 wherein the olefin is 1-dodecene.

41. The composition of claim 1 wherein said olefine adduct of a hydroxy ester derivative is an open chain derivative.

42. The composition of claim 1 wherein said reaction product is made from alpha-olefins or internal olefins.

43. The composition of claim 42 wherein the alpha olefin is selected from the groups consisting of propylene, 1-butene, 1-hexene, 4-methyl-1-pentene, 1-octene, 1-decene and 1-dodecene or oligomers or mixtures thereof.

44. The composition of claim 1 wherein the olefin is 1-butene.

45. The composition of claim 43 wherein the olefin is a polybutene oligomer.

46. The composition of claim 43 wherein the olefin is a polydecene/octene oligomer.

47. The composition of claim 43 wherein the olefin is 1-decene.

48. The composition of claim 43 wherein the olefin is 1-dodecene.

49. The composition of claim 1 wherein the olefinic ester is pentaerythritol tetraoleate.

50. The composition of claim 1 wherein the phosphorus-sulfur containing moieties are derived from phosphorodithioic acids selected from the group consisting of O,O-Dialkyl phosphorodithioic acids, O,O-diaryl phosphorodithioic acids, diol-derived phosphorodithioic acid, ether alcohol-derived phosphorodithioic acids, alkyl catetchol-derived or resorcinol-derived phosphorodithioic acids, alkyl-aryl and aryl-alkyl derived phosphorodithioic cids, hydroxyester-derived phosphorodithioic acids, polyol-derived phosphorodithioic acids, or mixtures thereof are reacted with said alpha-olefins, internal olefins or functionalized olefins to form additional products as shown in the generalized reaction below:

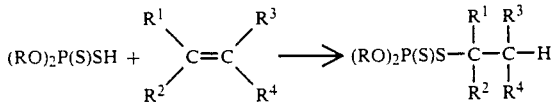

where R is $C_3$ to about $C_{30}$ hydrocarbyl or $C_3$ to about $C_{30}$ hydrocarbyl/oxyhydrocarbylene, or oxygen containing hydrocarbyl, or sulfur, nitrogen-containing hydrocarbyl, or heterocyclic containing-hydrocarbyl, or mixtures thereof:

where $R^1$, $R^2$, $R^3$, $R^4$ are hydrogen (with the proviso all can not be hydrogen at the same time) or $C_1$ to about $C_{500}$ hydrocarbyl, or sulfur/oxygen/nitrogen containing hydrocarbyl, or heterocyclic containing hydrocarbyl or mixtures thereof.

51. The composition of cliam 50 wherein said product of reaction is derived from decene-1 and 1,2-dodecane diol-derived phosphorodithioic acid.

52. The composition of cliam 50 wherein said addition product is derived from pentaerythritol tetraoleate 1,2-dodecane diol-derived phosphorodithioic acid.

53. The composition of claim 50 wherein said addition reaction product is derived polybutene and 1,2-dodecane diol-derived phosphorodithioic acid.

54. The composition of claim 50 wherein said product is derived from the reaction of dodecyl catechol phosphorus pentasulfide, and decene-1.

55. The composition of cliam 50 wherein said addition reaction product is derived from dodecyl catetchol, phosphorus pentasulfide, and polybutene.

56. The composition of claim 1 wherein said oil of lubricating viscosity is selected from minerals, synthetic oils and mixtures thereof.

57. The composition of claim 56 wherein said oil is a mineral oil.

58. The composition of claim 56 wherein said oil is a synthetic oil.

59. The composition of claim 56 wherein said oil is a mixture of minerals and synthetic oils.

60. The composition of claim 1 wherein said composition is a grease composition.

61. The composition of claim 1 wherein said grease is a synthetic and/or mineral oil ithium complex thickened grease.

62. The composition of claim 1 containing from about 0.01 to about 10% by weight of total composition of said additive product of reaction.

63. The composition of claim 62 containing 1.0 wt % of said additive product of reaction.

64. The lubricant composition comprising from about 50 to about 100% of a product of reaction as described in claim 1.

65. The lubricant of claim 64 containing at least 10 to about 90% of said product of reaction.

66. A process for improving the lubricating properties of lubricants comprising adding to said lubricant from 0.001 or less to about 100% of a product of reaction as described in claim 1.

67. The process of cliam 66 wherein from about 60 to about 90% by weight of the total composition of said product of reaction is added to an oil of lubricating viscosity or grease or other solid lubricant prepared therefrom and wherein said oil of lubricating viscosity is selected from mineral oils, synthetic oils or mixtures of mineral and synthetic oils.

68. The composition of claim 1 wherein said hydroxy-ester phosphorodithioate-olefin adduct is derived from the olefinic ester pentaerythritol tetraoleate.

* * * * *